US008112988B2

(12) United States Patent
Elwart

(10) Patent No.: US 8,112,988 B2
(45) Date of Patent: Feb. 14, 2012

(54) SYSTEM AND METHOD FOR DESULFATING A $NO_x$ TRAP

(75) Inventor: Shane Elwart, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1734 days.

(21) Appl. No.: 11/377,959

(22) Filed: Mar. 16, 2006

(65) Prior Publication Data

US 2007/0214773 A1 Sep. 20, 2007

(51) Int. Cl.
*F01N 3/00* (2006.01)
*F01N 3/10* (2006.01)

(52) U.S. Cl. ..... 60/295; 60/274; 60/277; 60/285; 60/301

(58) Field of Classification Search ..... 60/273, 60/277, 284, 285, 295, 301, 274, 297
See application file for complete search history.

(56) References Cited

U.S. PATENT DOCUMENTS 5,560,200 A * 10/1996 Maus et al. ..... 60/274
5,675,967 A * 10/1997 Ries-Mueller ..... 60/274
6,244,046 B1 6/2001 Yamashita
6,484,493 B2 11/2002 Takanohashi
6,668,544 B1 * 12/2003 Baerts ..... 60/277
2004/0040287 A1 * 3/2004 Beutel et al. ..... 60/285
2004/0055280 A1 3/2004 Nishizawa et al.
2005/0109021 A1 * 5/2005 Noirot et al. ..... 60/295
2005/0115227 A1 6/2005 Surnilla et al.
2006/0000200 A1 * 1/2006 Pott et al. ..... 60/285
2006/0162321 A1 * 7/2006 Zillmer et al. ..... 60/295
2007/0234710 A1 * 10/2007 Franz ..... 60/295

FOREIGN PATENT DOCUMENTS

DE 19926148 A1 * 12/2000
FR 2825412 A1 * 12/2002
WO WO 2005066468 A2 * 7/2005

OTHER PUBLICATIONS

Hahn et al., English Abstract of DE 19926148 A1, Dec. 14, 2000.*
Adler et al., English Abstract of FR 2825412 A1, Dec. 6, 2002.*

* cited by examiner

*Primary Examiner* — Thomas Denion
*Assistant Examiner* — Audrey K Bradley
(74) *Attorney, Agent, or Firm* — Allan J. Lippa; Alleman Hall McCoy Russell & Tuttle LLP

(57) ABSTRACT

A method is described for controlling an engine with a $NO_x$ trap. The method may include adjusting timing of subsequent desulfation based upon a delay between initiating the desulfation process and a temperature increase in the $NO_x$ trap.

13 Claims, 3 Drawing Sheets

SYSTEM AND METHOD FOR DESULFATING A $NO_x$ TRAP

BACKGROUND AND SUMMARY

Various mechanisms have been developed to reduce $NO_x$ emissions from lean-burning engines. One mechanism is a catalyst known as a $NO_x$ trap. The $NO_x$ trap is a catalytic device typically positioned downstream of the catalytic converter in an emissions system, and is configured to retain $NO_x$ when the engine is running a lean air/fuel mixture for eventual reduction when the engine runs a more rich air/fuel mixture. A typical $NO_x$ trap includes an alkali or alkaline metal, such as barium or calcium, to which $NO_x$ adsorbs when the engine is running a lean air/fuel mixture. The engine can then be configured to periodically run a richer air/fuel mixture to produce carbon monoxide, hydrogen gas and various hydrocarbons to reduce the $NO_x$ in the trap, thus decreasing $NO_x$ emissions and regenerating the trap.

The use of a $NO_x$ trap can substantially reduce $NO_x$ emissions from a lean-burning engine. However, $NO_x$ traps are also susceptible to poisoning from sulfur in fuels, which may adsorb to the $NO_x$ adsorption sites in the form of sulfate ($SO_4^{2-}$) or other oxidized sulfur compounds. These materials may be generally referred to as "$SO_x$", and may prevent $NO_x$ from adsorbing to trap surfaces, thereby impeding proper trap performance.

Various methods of desulfating ("de$SO_x$") $NO_x$ traps may be used. In general, these methods involve heating the $NO_x$ trap to a temperature sufficient to allow the reduction of $SO_x$, and then producing a rich exhaust to reduce the $SO_x$. However, it may be difficult to determine when trap performance has degraded sufficiently due to sulfur poisoning to perform a de$SO_x$ process. Furthermore, as the trap is aged thermally and/or chemically, the interval at which de$SO_x$ processes are needed may change over time, thereby contributing to the difficulty in determining when to perform a de$SO_x$ process.

The inventors herein have realized that desulfation may be more efficiently performed by following a method of controlling the engine, wherein the method comprises initiating a desulfation process in the $NO_x$ trap; measuring a delay between initiating the desulfation process and detecting a temperature increase in the $NO_x$ trap; and adjusting an engine operating parameter based upon the delay between initiating the desulfation process and detecting a temperature increase in the $NO_x$ trap. The engine operating parameter may be related to the timing of performing a subsequent de$SO_x$ process, and/or may be related to an engine operating condition used during a de$SO_x$ process.

DETAILED DESCRIPTION OF THE DEPICTED EMBODIMENTS

Figure 1:
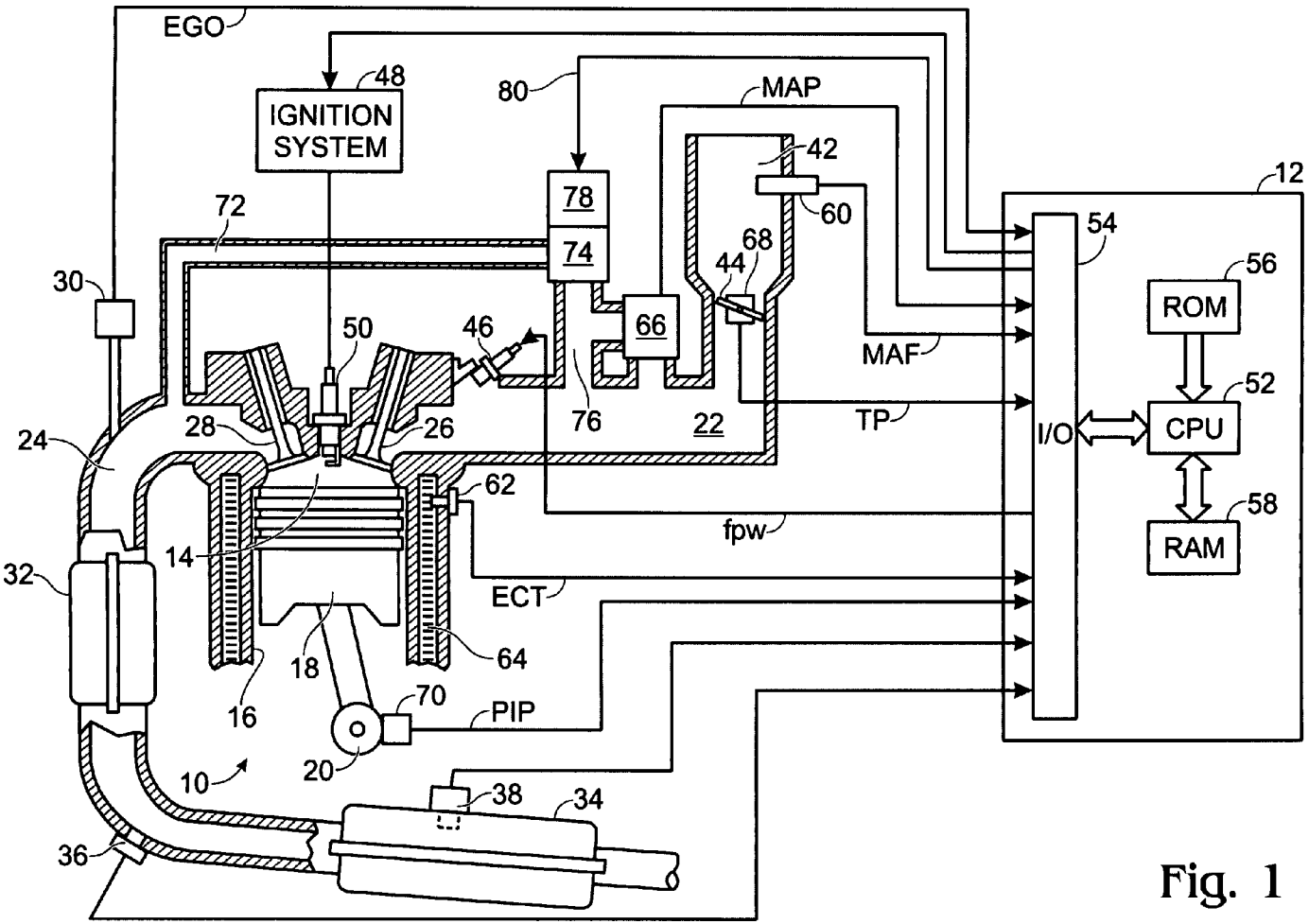
FIG. 1 shows a schematic depiction of an exemplary embodiment of an internal combustion engine.

FIG. 1 shows a schematic depiction of an exemplary embodiment of an internal combustion engine 10. Engine 10 typically includes a plurality of cylinders, one of which is shown in FIG. 1, and is controlled by an electronic engine controller 12. Engine 10 includes a combustion chamber 14 and cylinder walls 16 with a piston 18 positioned therein and connected to a crankshaft 20. Combustion chamber 14 communicates with an intake manifold 22 and an exhaust manifold 24 via a respective intake valve 26 and exhaust valve 28. An exhaust gas oxygen sensor 30 is coupled to exhaust manifold 24 of engine 10. A three-way catalyst 32 is connected to and receives feedgas from exhaust manifold 24, and a $NO_x$ trap 34 is connected to and receives emissions from three-way catalyst 32. Furthermore, a first temperature sensor 36 is positioned between three-way catalyst 32 and $NO_x$ trap 34, and a second temperature sensor 38 is positioned at $NO_x$ trap 34. Engine 10 is depicted as a port-injection spark-ignition gasoline engine. However, it will be appreciated that the systems and methods disclosed herein may be used with any other suitable engine, including direct-injection engines, and compression ignition engines including but not limited to diesel engines.

Intake manifold 22 communicates with a throttle body 42 via a throttle plate 44. Intake manifold 22 is also shown having a fuel injector 46 coupled thereto for delivering fuel in proportion to the pulse width of signal (fpw) from controller 12. Fuel is delivered to fuel injector 46 by a conventional fuel system (not shown) including a fuel tank, fuel pump, and fuel rail (not shown). Engine 10 further includes a conventional distributorless ignition system 48 to provide an ignition spark to combustion chamber 14 via a spark plug 50 in response to controller 12. In the embodiment described herein, controller 12 is a conventional microcomputer including: a microprocessor unit 52, input/output ports 54, an electronic memory chip 56, which may be electronically programmable memory, a random access memory 58, and a conventional data bus.

Controller 12 receives various signals from sensors coupled to engine 10, in addition to those signals previously discussed, including: measurements of inducted mass air flow (MAF) from a mass air flow sensor 60 coupled to throttle body 42; engine coolant temperature (ECT) from a temperature sensor 62 coupled to cooling jacket 64; a measurement of manifold pressure (MAP) from a manifold absolute pressure sensor 66 coupled to intake manifold 22; a measurement of throttle position (TP) from a throttle position sensor 68 coupled to throttle plate 44; and a profile ignition pickup signal (PIP) from a Hall effect sensor 70 coupled to crankshaft 40 indicating an engine speed (N).

Exhaust gas is delivered to intake manifold 22 by a conventional EGR tube 72 communicating with exhaust manifold 24, EGR valve assembly 74, and EGR orifice 76. Alternatively, tube 72 could be an internally routed passage in the engine that communicates between exhaust manifold 24 and intake manifold 22.

As described earlier, $NO_x$ trap 34 may become poisoned by SOX over time. This occurs when SOX molecules bind to the $NO_x$ absorption sites, thereby preventing the absorption of $NO_x$ and harming trap performance. Therefore, $NO_x$ trap 34 may periodically undergo a de$SO_x$ process to remove $SO_x$ from $NO_x$ adsorption sites. Typical de$SO_x$ processes involve first heating the $NO_x$ trap, for example, by oscillating the air/fuel ratio to cause exothermic catalytic reactions in the trap, and then providing a rich exhaust to the trap for the reduction of adsorbed $SO_x$. A rich/lean oscillation during $SO_x$ reduction may be used to help reduce hydrogen sulfide production.

Over time, the elevated temperatures used in operating and desulfating $NO_x$ trap 34, as well as the chemical processes that occur in the trap, may cause a coarsening of the active materials within $NO_x$ trap 34, which may thereby reduce the number of $NO_x$ adsorption sites within $NO_x$ trap 34. This process may be referred to as aging. As the number of $NO_x$ adsorption sites within $NO_x$ trap 34 decreases with aging, $NO_x$ trap 34 may require the use of more frequent $deSO_x$ processes to ensure proper trap operation. However, the aging of a $NO_x$ trap may dependent upon specific trap operating conditions. Therefore, difficulties may arise in determining when and how often to perform $deSO_x$ processes as $NO_x$ trap 34 ages.

One possible method of determining when $deSO_x$ is required may be to utilize $NO_x$ sensors positioned upstream and downstream of $NO_x$ trap 34 to estimate the $NO_x$ storage capacity of the trap during engine operation. When the $NO_x$ storage capacity is determined to have dropped below a predetermined level, $deSO_x$ may be performed. While such a method would allow the interval at which $deSO_x$ is performed to be adapted over time to account for aging of the $NO_x$ trap, it may also have drawbacks. For example, currently available $NO_x$ sensors may be expensive. Furthermore, the output of current $NO_x$ sensors may drift over time, making it difficult to determine whether the $NO_x$ storage capacity estimate is correct.

As an alternative to $NO_x$ sensors, a diagnostic process utilizing a temperature sensor associated with $NO_x$ trap 34 (for example, temperature sensor 38) may be used to determine an aging condition of $NO_x$ trap 34. For example, at the initiation of a $deSO_x$ process, the air/fuel ratio is oscillated in such a manner as to raise the temperature of the $NO_x$ trap via exothermic catalytic reactions in the trap. Over time, as the surface area of the trap coarsens due to thermal and/or chemical aging, the delay between the initiation of $deSO_x$ air/fuel oscillations and the initial temperature rise in the catalyst may increase due to the aging-related loss of catalytic sites in the $NO_x$ trap. This delay may be measured and used to determine an interval at which to perform a subsequent $deSO_x$ process.

Figure 3:
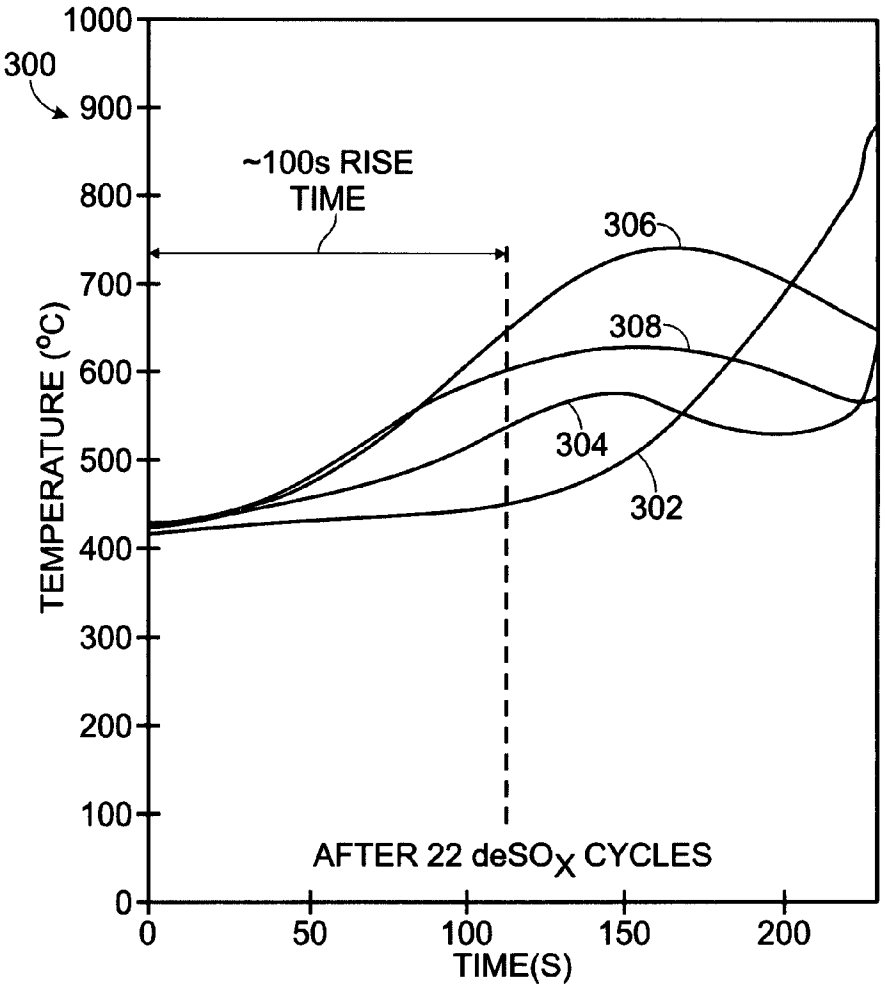
FIG. 3 shows a graph representing the radial temperature profile of a $NO_x$ trap as a function of time during a de$SO_x$ process, after the $NO_x$ trap has undergone twenty two prior de$SO_x$ processes.
Figure 2:
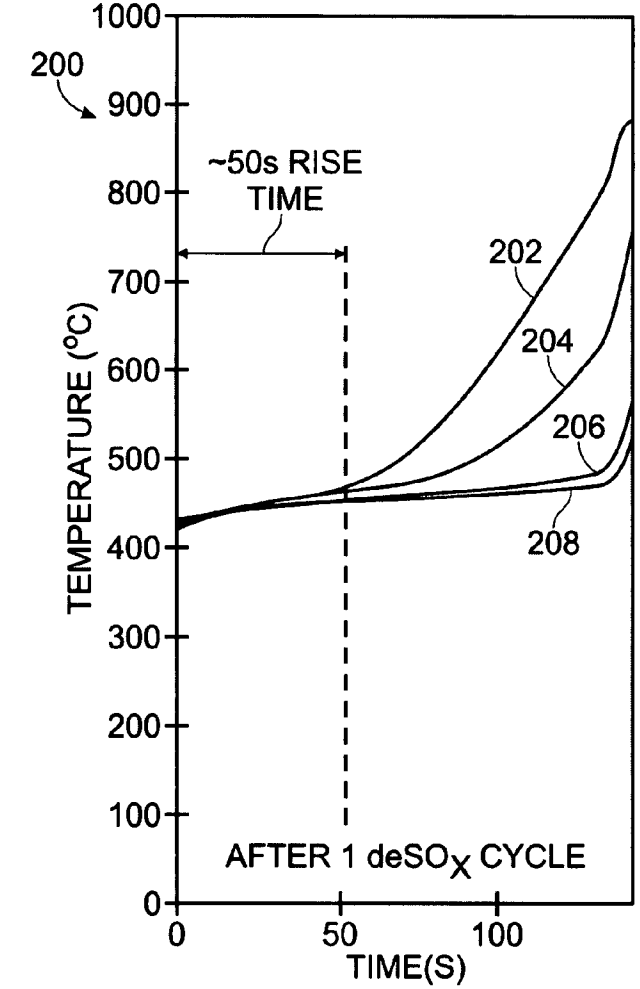
FIG. 2 shows a graph representing the radial temperature profile of a $NO_x$ trap as a function of time during a de$SO_x$ process, after the $NO_x$ trap has undergone one prior de$SO_x$ process.
Figure 4:
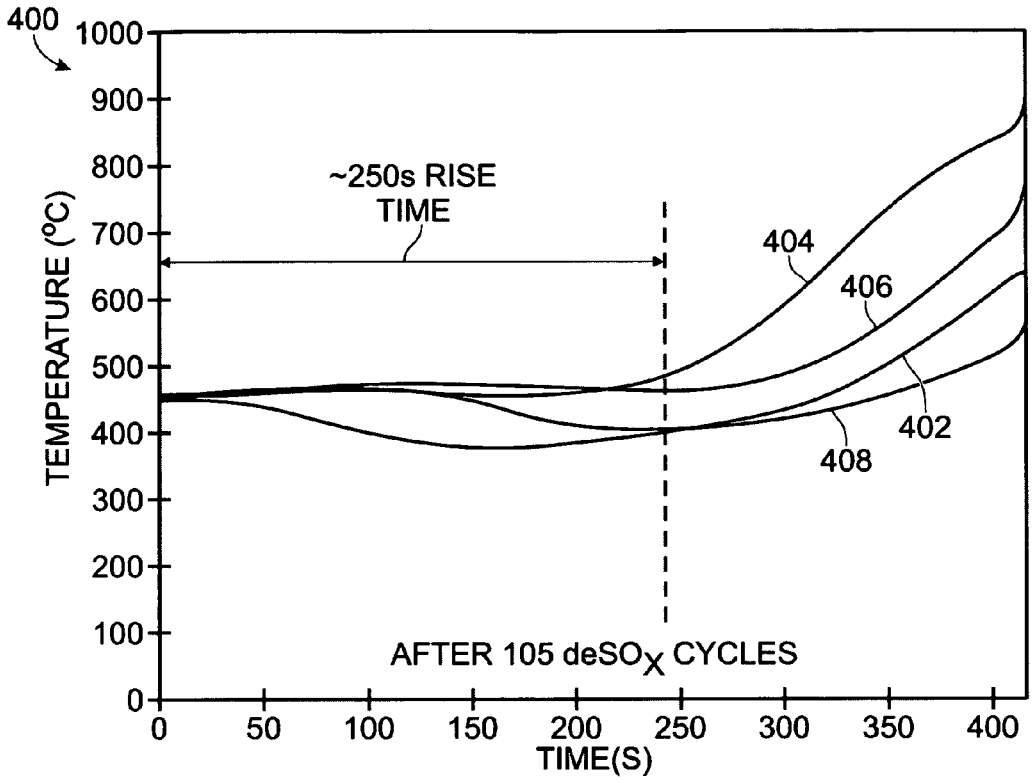
FIG. 4 shows a graph representing the radial temperature profile of a $NO_x$ trap as a function of time during a de$SO_x$ process, after the $NO_x$ trap has undergone one hundred five prior de$SO_x$ processes.

FIGS. 2-4 show the effect of $NO_x$ trap aging on the heating of an exemplary $NO_x$ trap during a $deSO_x$ process as a function of the number of prior $deSO_x$ processes performed on the trap. In each graph, each line represents the temperature at a different radial location in the $NO_x$ trap. This data is taken from SAE 2002-01-2871, the disclosure of which is hereby incorporated by reference. Referring first to FIG. 2, line 202 of graph 200 shows the temperature of the $NO_x$ trap at the center of the trap approximately 4" from the rear of the trap as a function of time during a $deSO_x$ cycle. As shown in FIG. 2, the temperature in this location of the trap begins to rise about 50 seconds after beginning the $deSO_x$ process. The other lines show the temperature at other locations in the trap. Specifically, line 204 shows the temperature at the center of the trap approximately 2" from the rear of the trap. Line 206 shows the temperature of the approximately 6" from the rear of the trap and approximately 5.25" radially from the centerline of the trap and line 208 shows the temperature approximately 1" from the rear of the trap and approximately 5.25" radially from the centerline of the trap.

Next, FIG. 3 shows the radial temperature profile of the same $NO_x$ trap as FIG. 2 after performing 22 $deSO_x$ cycles. Line 302 of graph 300, which shows the temperature at the same radial and axial location as line 202 of FIG. 2, shows the increase in trap temperature beginning approximately 100 seconds after initiating the $deSO_x$ process. Lines 304, 306 and 308 of FIG. 3 correspond to temperatures taken at the same radial and axial locations of lines 204, 206 and 208 of FIG. 2, respectively. Likewise, FIG. 4 shows the radial temperature profile of the $NO_x$ trap after performing 105 $deSO_x$ cycles. Line 402 of graph 400, which shows the temperature at the same radial and axial location as lines 302 and 202 of FIGS. 3 and 2, shows the increase in trap temperature beginning approximately 250 seconds after initiating the $deSO_x$ process. Lines 404, 406 and 408 of FIG. 3 correspond to temperatures taken at the same radial and axial locations of lines 204, 206 and 208 of FIG. 2, respectively. From FIGS. 2-4, it can be seen that the trap heating delay may vary with aging, and therefore may be used to determine an estimate of the aging condition of the trap. The aging condition of the trap likewise may be correlated with a specific interval at which to perform a subsequent $deSO_x$ process. This correlation may be performed in any suitable manner, for example, via an experimentally determined lookup table stored in memory on controller 12, or via a mathematical model.

Figure 5:
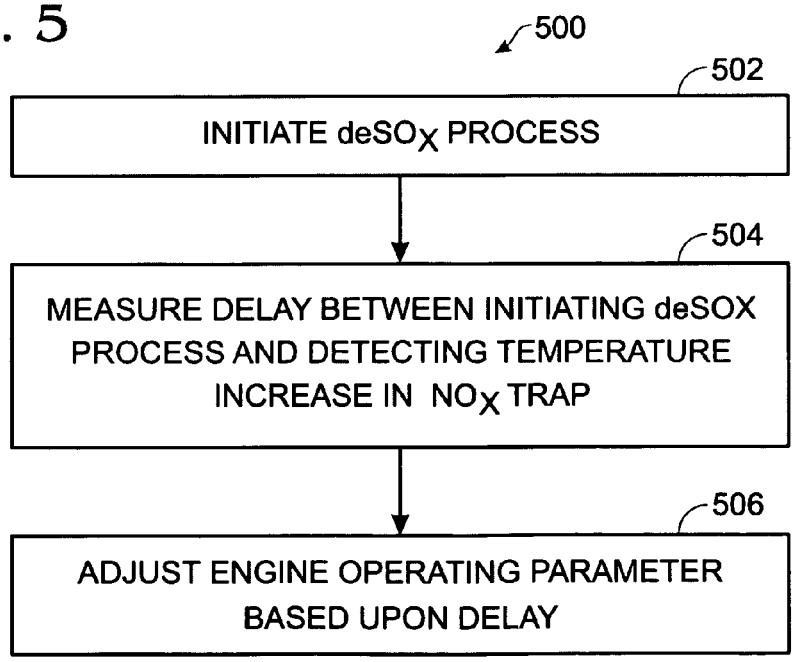
FIG. 5 shows a flow diagram of an embodiment of a method of controlling an engine according to the present disclosure.

FIG. 5 shows, generally at 500, a flow diagram of an exemplary embodiment of a method for operating an engine that uses a measurement of a $NO_x$ trap heating temperature delay during a $deSO_x$ process to operate an engine. Method 500 first includes initiating a $NO_x$ trap $deSO_x$ process at 502. Next, method 500 includes measuring a delay between initiating the $deSO_x$ process and detecting an increase in the temperature of the $NO_x$ trap at 504. Method 500 then includes adjusting an engine operating parameter based upon the delay measured.

The temperature of the $NO_x$ trap may be measured in any suitable manner. For example, a suitable temperature sensor (for example, temperature sensor 34 shown in FIG. 1) may be provided on or within the $NO_x$ trap. Such a sensor may be located in any suitable position on the $NO_x$ trap, and/or may be configured to determine the temperature of the $NO_x$ trap at any desired radial depth within the $NO_x$ trap. Suitable positions and/or radial depths include those positions and/or depths at which the production of heat by the $deSO_x$ reaction can be detected.

Likewise, the delay between initiating the $deSO_x$ process and detecting an increase in the $NO_x$ trap temperature may also be measured in any suitable manner. For example, the delay may be measured as a function of time, engine cycles, or any other suitable quantity.

Some portion of the increase in temperature of $NO_x$ trap 34 during a $deSO_x$ process may occur due to increased exhaust temperatures, rather than due to catalytic reactions occurring in the $NO_x$ trap. Therefore, when measuring the delay between starting the $deSO_x$ process and detecting a temperature increase of the $NO_x$ trap, distinguishing the portion of the temperature increase arising from the increased exhaust temperatures from the portion of the temperature increase arising from reaction exotherms may allow a more accurate measurement of the delay to be made, as the slower temperature increase due to aging arises primarily from the latter. Distinguishing the two components of the heating may therefore allow a more accurate determination to be made of the delay in temperature increase caused by exothermic reactions within the $NO_x$ trap.

The temperature increase due to increased exhaust temperature may be distinguished from the temperature increase from the catalytic reactions in the trap in any manner. For example, the derivative of the signal from temperature sensor 38 may used to determine the interval at which the $deSO_x$ reactions begin instead of the raw signal. This may allow the temperature increase due to the catalytic reactions in the $NO_x$ trap to be distinguished from the temperature increase due to the exhaust temperatures by highlighting any changes in the rate of increase of the $NO_x$ trap temperature caused by the catalytic reactions. Such heating rate changes can be seen in FIGS. 2-4, where the slope of each of lines 202, 302 and 402 increases upon the initiation of the catalytic reactions.

Alternatively, the temperature increase from exhaust heating may be distinguished from the temperature increase from the catalytic reactions through the use of two temperature sensors, such as temperature sensors 36 and 38 from FIG. 1. Temperature sensor 36, positioned upstream of $NO_x$ trap 34, may be used to monitor the temperature of the exhaust provided to $NO_x$ trap 34. Temperature sensor 38, associated with $NO_x$ trap 34, may be used to monitor the temperature of the $NO_x$ trap, as described above. From the outputs of temperature sensor 36 and temperature sensor 38, it may be determined what portion of the temperature rise of $NO_x$ trap 34 is attributable to the exhaust gas temperature increase and what portion is attributable to heat produced by catalytic reactions within the $NO_x$ trap. For example, variables such as the exhaust temperature, flow rate, and/or the thermal mass of $NO_x$ trap 34 may be used to model the heating of $NO_x$ trap 34 as a function of the exhaust conditions, and any heating additional to that predicted by the model may be attributed to the catalytic reactions. Alternatively, a map of the heating profile of $NO_x$ trap 34 as a function of variable such as the exhaust flow rate and exhaust temperature may be experimentally determined and stored in memory on controller 12. In this manner, the measured temperature of $NO_x$ trap 34 may be compared to the map to distinguish the heating caused by the exhaust from the heating caused by the catalytic reactions within $NO_x$ trap 34.

Referring again to FIG. 5, any suitable engine operating parameter may be adjusted in response to determining the delay between initiating a $deSO_x$ process and detecting a production of heat by a catalytic reaction in the $NO_x$ trap at 504. For example, engine parameters associated with starting a subsequent $deSO_x$ process may be adjusted based upon the determined delay. This may involve adjusting an interval between a current $deSO_x$ process and a subsequent $deSO_x$ process (for example, a time interval, an engine cycle interval, etc.), and/or may involve adjusting a parameter related to exhaust conditions (for example, parameters related to valve timing, injection timing, exhaust gas recirculation, etc.). Furthermore, the delay determined between initiating a $deSO_x$ process and detecting a production of heat by a catalytic reaction in the $NO_x$ trap may also be used to estimate a $NO_x$ storage capacity of the $NO_x$ trap, and thereby to determine an interval at which to purge the $NO_x$ trap of stored $NO_x$.

The adjustment made to the engine operating parameter may be determined in any suitable manner. For example, as described above, a look up table correlating specific measured delays with specific operating parameter adjustments may be stored in memory on controller 12. Alternatively, a mathematical model may be used that calculates the operating parameter adjustments from the delay and (potentially) other inputs such as exhaust flow rate, EGR rate, fuel injection timing, fuel injection volume, etc. It will be appreciated that these methods of adjusting the engine operating parameter are merely exemplary, and that any other suitable method may be used.

The embodiments of systems and methods disclosed herein for desulfating a $NO_x$ trap are exemplary in nature, and these specific embodiments are not to be considered in a limiting sense, because numerous variations are possible. The subject matter of the present disclosure includes all novel and non-obvious combinations and subcombinations of the various systems and methods for monitoring a temperature rise in the $NO_x$ trap, and other features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the various features, functions, elements, and/or properties disclosed herein may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A method of controlling an engine with a $NO_x$ trap, comprising:

initiating a desulfation process in the $NO_x$ trap, where initiating the desulfation process comprises oscillating an air/fuel ratio between rich and lean to raise exhaust temperature via exothermic catalytic reactions in the $NO_x$ trap;

measuring a delay between: initiating the desulfation process from an upstream of the $NO_x$ trap exhaust temperature sensor signal providing an indication of the raised exhaust temperature, and detecting an initial temperature increase in the $NO_x$ trap after the exhaust temperature is raised, the initial temperature increase in the $NO_x$ trap being detected by a $NO_x$ trap temperature sensor signal; and performing subsequent desulfation processes in the $NO_x$ trap more frequently based upon an increase in the delay.

2. The method of claim 1, wherein measuring the delay between initiating the desulfation process and detecting the initial temperature increase in the $NO_x$ trap comprises receiving a signal from a temperature sensor associated with the $NO_x$ trap and determining a derivative of the signal.

3. The method of claim 1, wherein the subsequent desulfation processes are based on a rate of change of temperature increase of the $NO_x$ trap.

4. The method of claim 1, further comprising adjusting a valve timing based upon the delay.

5. The method of claim 1, further comprising adjusting at least one of a valve timing, a fuel injection timing, a fuel injection volume, an exhaust temperature, and an exhaust flow rate based upon the delay.

6. A method of controlling an engine with a $NO_x$ trap, comprising:

initiating a desulfation process in the $NO_x$ trap by oscillating an air/fuel ratio between rich and lean to raise exhaust temperature via exothermic catalytic reactions in the $NO_x$ trap;

detecting an initial temperature increase in the $NO_x$ trap;

measuring a delay between: initiating the desulfation process from an upstream of the $NO_x$ trap exhaust temperature sensor signal, and detecting the initial temperature increase in the $NO_x$ trap from a $NO_x$ trap temperature sensor signal; and performing subsequent desulfation processes in the $NO_x$ trap more frequently based upon an increase in the delay.

7. The method of claim 6, wherein measuring the delay between initiating the desulfation process and detecting the initial temperature increase in the $NO_x$ trap comprises receiving a signal from a temperature sensor associated with the $NO_x$ trap and determining a derivative of the signal.

8. The method of claim 6, further comprising adjusting a valve timing based on the delay.

9. The method of claim 6, further comprising adjusting at least one of a valve timing, a fuel injection timing, a fuel injection volume, an exhaust temperature, and an exhaust flow rate based on the delay.

10. An apparatus, comprising:

an internal combustion engine;

a $NO_x$ trap for treating $NO_x$ emissions from the internal combustion engine;

a temperature sensor associated with the $NO_x$ trap; and a controller in electrical communication with the temperature sensor, wherein the controller comprises memory comprising instructions stored thereon, the instructions being executable to initiate a desulfation process in the $NO_x$ trap by oscillating an air/fuel ratio between rich and lean to raise exhaust temperature via exothermic catalytic reactions in the $NO_x$ trap; to detect an initial temperature increase in the $NO_x$ trap; to measure a delay between: initiating the desulfation process from an upstream of the $NO_x$ trap exhaust temperature sensor signal, and detecting the initial temperature increase in the $NO_x$ trap from a $NO_x$ trap temperature sensor signal; and to perform subsequent desulfation processes in the $NO_x$ trap more frequently based upon an increase in the delay.

11. The apparatus of claim 10, wherein the memory further comprises instructions executable to measure the delay between initiating the desulfation process and detecting the initial temperature increase in the $NO_x$ trap by receiving a signal from a temperature sensor associated with the $NO_x$ trap and determining a derivative of the signal.

12. The apparatus of claim 10, wherein the subsequent desulfation processes are based on a rate of change of temperature increase of the $NO_x$ trap.

13. The method of claim 10, wherein the memory further comprises instructions executable to adjust a valve timing based upon the delay.

* * * * *